United States Patent [19]

Guimond et al.

[11] Patent Number: 4,941,846

[45] Date of Patent: Jul. 17, 1990

[54] QUICK CONNECT/DISCONNECT MICROWAVE CONNECTOR

[75] Inventors: Ronald Guimond, Amesbury; Anthony Martiniello, Wilmington; David W. Hardy, Rowley, all of Mass.; Raymond Tellier, Salem, N.H.

[73] Assignee: Adams-Russell Electronic Company, Inc., Amesbury, Mass.

[21] Appl. No.: 359,161

[22] Filed: May 31, 1989

[51] Int. Cl.[5] ..... H01R 17/18

[52] U.S. Cl. ..... 439/578; 439/180; 439/256; 439/254

[58] Field of Search ..... 439/322, 676, 152–159, 439/180, 253, 254, 256, 257, 258, 578–585

[56] References Cited

U.S. PATENT DOCUMENTS

| | | | |
|---|---|---|---|
| 3,430,184 | 2/1969 | Acord . | |
| 3,452,316 | 6/1969 | Panek . | |
| 3,590,377 | 6/1971 | Gunti . | |
| 3,671,922 | 6/1972 | Zerlin et al. . | |
| 3,694,793 | 9/1972 | Concelman . | |
| 3,815,079 | 6/1974 | Auriana . | |
| 3,828,303 | 8/1974 | Sladek et al. . | |
| 3,858,156 | 12/1974 | Zarro . | |
| 3,888,559 | 6/1975 | Geib . | |
| 3,953,098 | 4/1976 | Avery et al. | 439/675 |
| 4,017,139 | 4/1977 | Nelson | 439/675 |
| 4,138,181 | 2/1979 | Hacker et al. | 439/258 |
| 4,208,082 | 6/1980 | Davies . | |
| 4,279,458 | 7/1981 | Knapp . | |
| 4,433,889 | 2/1984 | Ratchford et al. | 439/258 |
| 4,545,633 | 10/1985 | McGeary | 439/675 |
| 4,620,760 | 11/1986 | Duncan . | |
| 4,632,480 | 12/1986 | Carpenter . | |
| 4,690,482 | 9/1987 | Chamberland . | |

*Primary Examiner*—David Pirlot

*Attorney, Agent, or Firm*—St. Onge Steward Johnston & Reens

[57] ABSTRACT

A quick connect/disconnect coaxial connector is described which can be used with unmodified standard coaxial couplings having externally-facing threads. The connector includes a coaxial line segment that is mounted inside a housing body. The latter has movable fingers with inwardly-facing ridges that interlock with the external thread of a coaxial coupling. The coaxial line segment interfits with the coupling for a microwave connection and is movably mounted with respect to the housing body. A sleeve having a cam surface is mounted over the housing body whereby, in a forward position, the fingers are caused to close on a coupling and interlock with its thread while in a rearward position, the fingers are allowed to release from the coupling. The coaxial line segment is spring biased so as to normally urge the fingers towards their release position and into coaxial abutment with a coupling when the fingers are interlocked with the coupling's external thread by the sleeve.

14 Claims, 2 Drawing Sheets

QUICK CONNECT/DISCONNECT MICROWAVE CONNECTOR

FIELD OF THE INVENTION

This invention generally relates to microwave connectors and more specifically to quick connect/disconnect coaxial connectors.

BACKGROUND OF THE INVENTION

Quick disconnect electrical plugs are known, see for example U.S. Pat. Nos. 3,430,184; 3,452,316; 4,208,082; 4,620,760; and 4,632,480. Similar quick connect/disconnect couplings have been proposed for coaxial lines, see for example U.S. Pat. No. 3,694,793 in which a coaxial plug is interlocked with a coaxial socket.

U.S. Pat. No. 3,858,156 shows and describes a push-on, pull-off type coaxial connector. U.S. Pat. No. 4,690,482 shows an SMA-type push-on coaxial connector. Another push-pull quick connect/disconnect coaxial connector for use in frequencies from 0.1 to 6 GHz is shown in U.S. Pat. No. 3,828,303. A locking push-pull coaxial connector is shown in U.S. Pat. No. 3,671,922.

U.S. Pat. No. 3,590,377 describes and shows a test fixture for microwave devices which need rapid engagement with coaxial connectors.

The prior art devices provide various techniques for making quick connections and disconnections with coaxial and other types connectors. However, in the testing of many microwave devices and the like, low SWR (standing wave ratios) are needed when quick connections are to be made and the connection should be relatively immune from physical manipulation of the connection.

SUMMARY OF THE INVENTION

In a microwave connector in accordance with the invention, a high quality microwave connection is obtained that is immune from loads placed on the connector and a cable to which it may be coupled while a quick connect/disconnect capability is provided.

This is achieved with one quick connect/disconnect connector in accordance with the invention by employing a coaxial line segment that can be pushed on and pulled off a conventional mating coupling to establish a high quality microwave connection. The coaxial line segment is placed within a housing body that has a plurality of movable fingers distributed around the coaxial line segment. The fingers have inwardly facing ridge portions that can mesh with a corresponding but outwardly facing screw thread on the coupling. A sleeve movably mounted on the housing body has an internal cam surface that, as the connector's coaxial line segment is pushed onto the coupling, causes the fingers to move so that their ridge portions interlock with the coupling's screw thread.

As described herein for one embodiment in accordance with the invention, the coaxial line segment is moveable relative to the housing body. Hence, when the forward end of the coaxial line segment seats on the microwave coupling to form a proper microwave connection, a shift in the position of the fingers relative to the segment can be tolerated. This assures an interlocking engagement between the connector and the coupling while preserving a high quality microwave connection.

The coaxial line segment as described herein is spring loaded with respect to the housing body that supports the fingers. This spring bias urges the moveable line segment towards the microwave coupling to preserve its connection therewith. The spring loading together with an appropriate cam provides a force on the fingers by which they are normally biased in their open position in which the microwave coupling can be received to place its screw thread opposite the meshing ridge portions on the fingers.

With a quick connect/disconnect microwave connector in accordance with the invention, a convenience pushon, pull-off connection can be made with a conventional connector that normally mates with a connector that is screwed on. For example, a connector of this invention can be made to connect with female type N connectors which have external threads that normally mate with a male type N that is screwed on.

Hence, when production testing is required with, for example, type N carrying equipment, the connector of this invention can be simply pushed on and pulled off quickly. Similar connectors can be provided for other connector types such as SMA or TNC. As a result, only one side of the interface with a type connector needs to be modified to provide a quick connect/disconnect capability.

It is, therefore, an object of the invention to provide a microwave connector that can be quickly connected to or disconnected from a microwave coupling while obtaining a high quality connection. It is a further object of the invention to provide a high quality connection with standard coaxial connectors in a quick manner.

These and other objects and advantages of the invention can be understood from the following description of a connector in accordance with the invention as shown in the drawings.

DETAILED DESCRIPTION OF DRAWINGS

Figure 1:
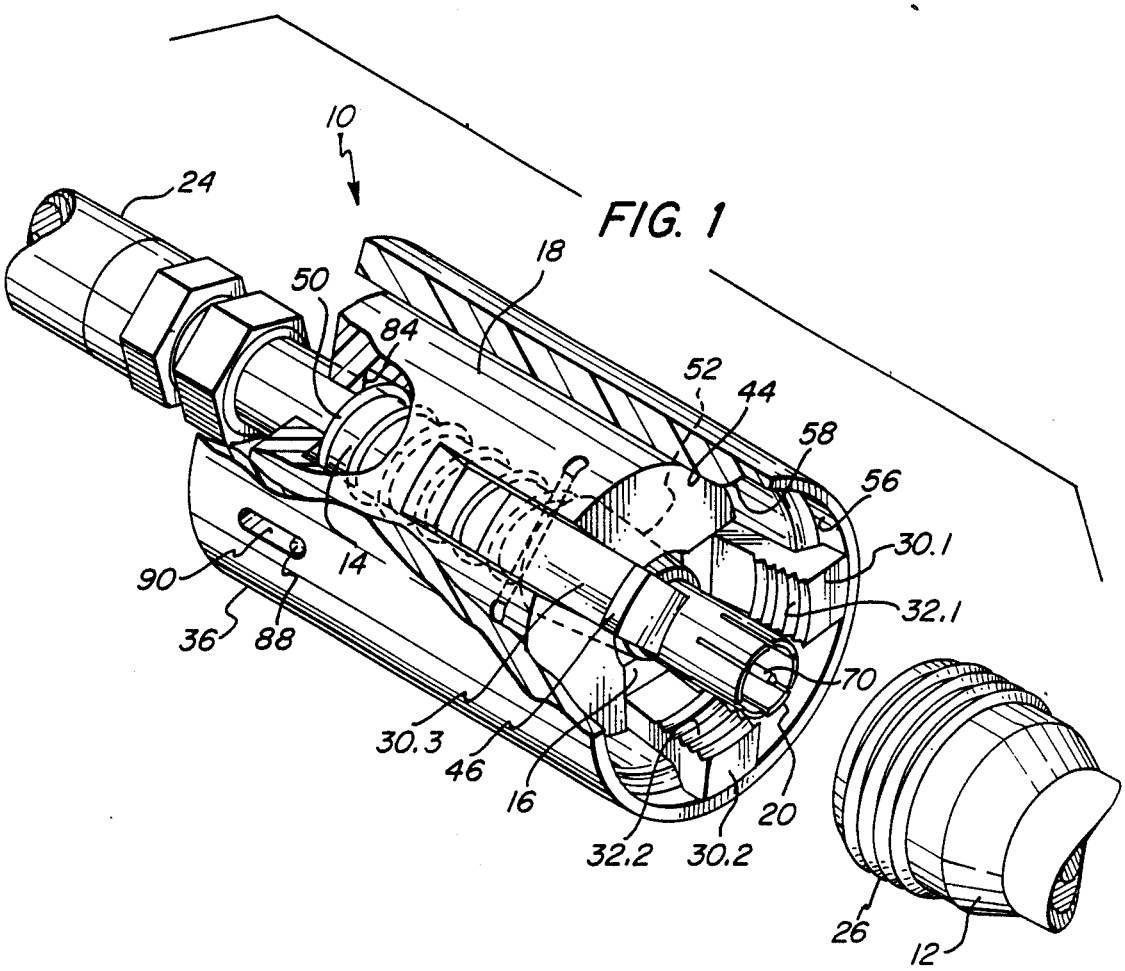
FIG. 1 is a perspective broken away view of a connector in accordance with the invention with a standard mating coupling.
Figure 2:
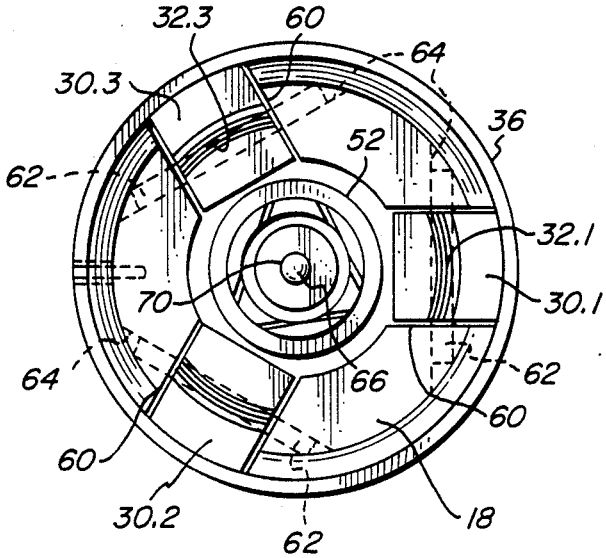
FIG. 2 is a forward end view of the connector of FIG. 1.
Figure 3:
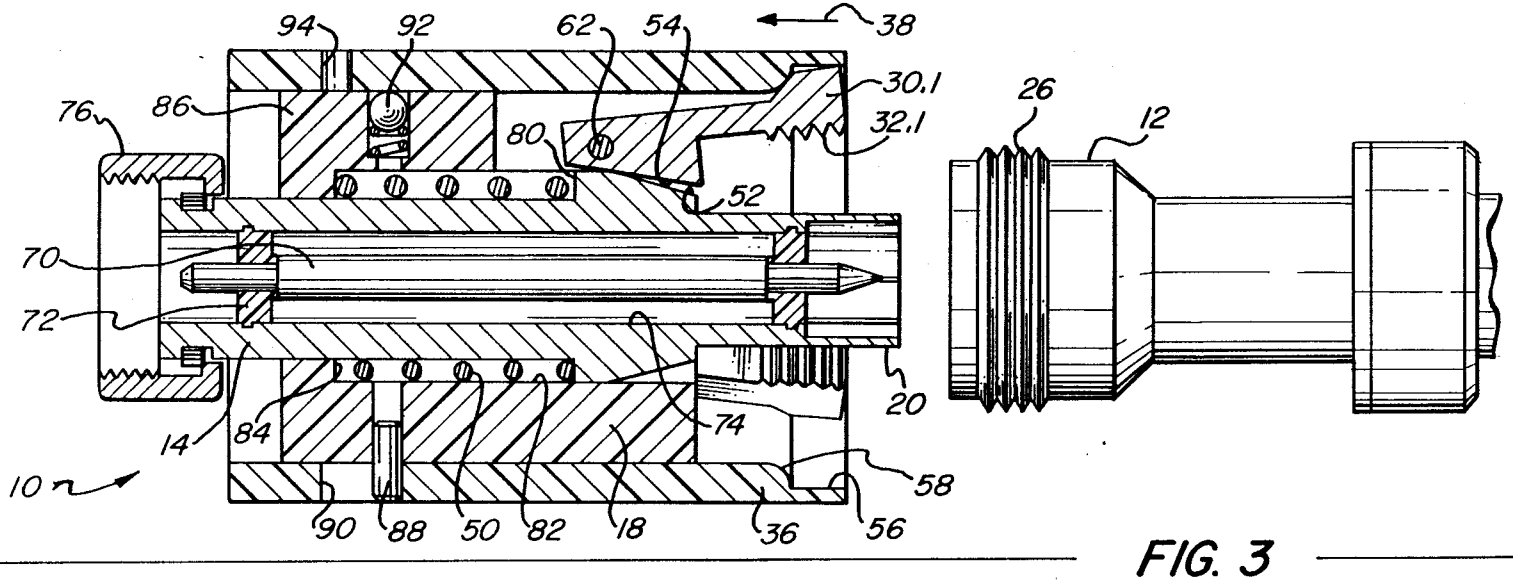
FIG. 3 is a side cross-section view of the connector of FIG. 1 taken along the line 3—3 prior to connection to a mating coupling.

With reference to FIGS. 1, 2 and 3, an illustrative microwave connector 10 in accordance with the invention is shown. The connector 10 can be pushed on and pulled off a conventional female type N connector coupling 12 though it is to be understood that the invention can be applied to various different types of connector such as SMA, TNC and other microwave couplings.

The term microwave as employed herein is not intended to define a particular range of wavelengths. Rather, the term microwave as used herein refers to the normal wavelengths encountered when using waveguides and coaxial cables and connectors. At such wavelengths, the connectors inevitably involve discontinuities where one conductor surface meets another. Such discontinuities tend to give rise to impedance mismatches that generate reflections. An overall evaluation of the connector is its standing wave ratio (SWR).

The smaller such ratio, the better impedance match it is able to provide.

Connector 10 is formed with a centrally-located coaxial line segment 14 that is moveably-mounted within a central through bore 16 of a housing body 18. The coaxial line segment 14 has a conventional axially-forward-located male connecting end 20 that mates with and inside the coaxial line portion 22, see FIG. 4, of type N coupling 12.

The push-on, pull-off capability of just the forward male end 20 onto type N coupling 12 is well-known. However, such connection by itself is not normally sufficiently reliable and able to maintain a low SWR. This is particularly and usually the case when a coaxial cable such as 24 is also connected to connector 20. Hence, conventional male type N connectors have a screw on sleeve whose internalscrew thread meshes with screw thread 26 on female type N coupling 212. The sleeve serves to firmly hold the coaxial line segment 14 in proper microwave connection with coupling 12. However, when the cable 24 needs to be successively-connected to many couplings 12 the screwing on and off of the conventional connector takes up an undesirable amount of valuable production time.

The connector 20 of this invention provides a simple push-on and pull-off ability with couplings such as 12 while retaining a strong reliable low SWR connection. This is achieved with a plurality of fingers 30.1, 30.2 and 30.3, that are pivotably-mounted to housing body 18. The fingers 30 are each provided with inwardly-facing circumferential ridge portions 32.1, 2.2 and 32.3. In the embodiment of the Figures, the ridge portions 32 are portions of the screw threads that mesh with the screw thread 26 on microwave coupling 12.

The fingers 30 are normally biased in an open position as shown in FIGS. 1 and 3 so as to be able to receive the microwave coupling 12. A cylindrical sleeve 36 is moveably-mounted to housing body 18 for movement in forward and rearward directions as indicated by respective arrows 38, 40. The inner wall of sleeve 36 serves as a cam surface 44 that operates against the outer surfaces 46 of fingers 30. Different shapes and forms of sleeve 36 can be used to provide its finger actuating function.

When the sleeve 36 is in its rearward position, the fingers 30 can open up so as to receive the coupling 12 with its screw thread 26. The fingers 30 are pivoted out by action of a spring load on the moveable coaxial line segment 14. A spring 50 is operative between segment 14 and housing body 18 so as to push a conical cam surface 52 on the outer surface of line segment 14 against cam surfaces 54 (see FIGS. 3) on the fingers 30.

The cam surface 44 on sleeve 36 has two parts, a forward annular part 56 that allows the fingers 30 to open and an annular rearward part 58 that acts against the outer surfaces 46 of fingers 30 to close them into an interlock with coupling 12. The transition between the flat portion of cam surface 58 to the recessed part 56 is rounded for smooth action by sleeve 36.

As illustrated in FIG. 2, the housing body 18 has a cylindrical shape with three radially, outwardly-spaced cut-outs 60 in which fingers 30 are placed. Pins 62 are press fit into holes 64 in the housing body so as to provide pivots for fingers 30. The cut-outs 60 are evenly angularly spaced about a central axis 66 and the pins 62 are aligned so as to intersect cut-outs 60 at right angles.

With reference to FIG. 3, the connector 10 is shown just prior to connection to a coupling 12. The coaxial line segment 14 has a central conductor 70 that is mounted with insulator spacers 72 inside an outer conductor 74. The segment 14 terminates with male type N connector 20 at a forward end and with a standard connector 76 at a rearward end. The outer cylindrical surface of segment 14 has the cam surface 52 which terminates at a rearward end to form a seat 80 for spring 70. Housing 18 has a counter bore 82 that terminates at a wall 84 that forms the other seat for coiled spring 50.

Sleeve 36 is captured to a rearward portion 86 of housing body 18 by way of a pin 88 that is press fit into part 86 and a slot 90 that is axially aligned so as to limit, with the cooperation of pin 88, the forward and rearward motion of sleeve 36 relative to housing body 18. A detent 91 in the form of a springloaded ball 92 and a complementary-sized hole 94 is provided to align with the interlocked forward position of sleeve 36 as shown in FIG. 4.

Spring 50 provides sufficient force to spring load coaxial line segment 14 forward and force conical cam surface 52 against surfaces 54 on fingers 30. This causes fingers 30 to pivot outwardly and seat against annular cam surface 56 of sleeve 36 while surfaces 54 prevent forward escape of segment 14. In this open position of fingers 30, the coupling 12 can be received with its screw thread 26 juxtaposed with the ridge portions 32 on fingers 30.

Figure 4:
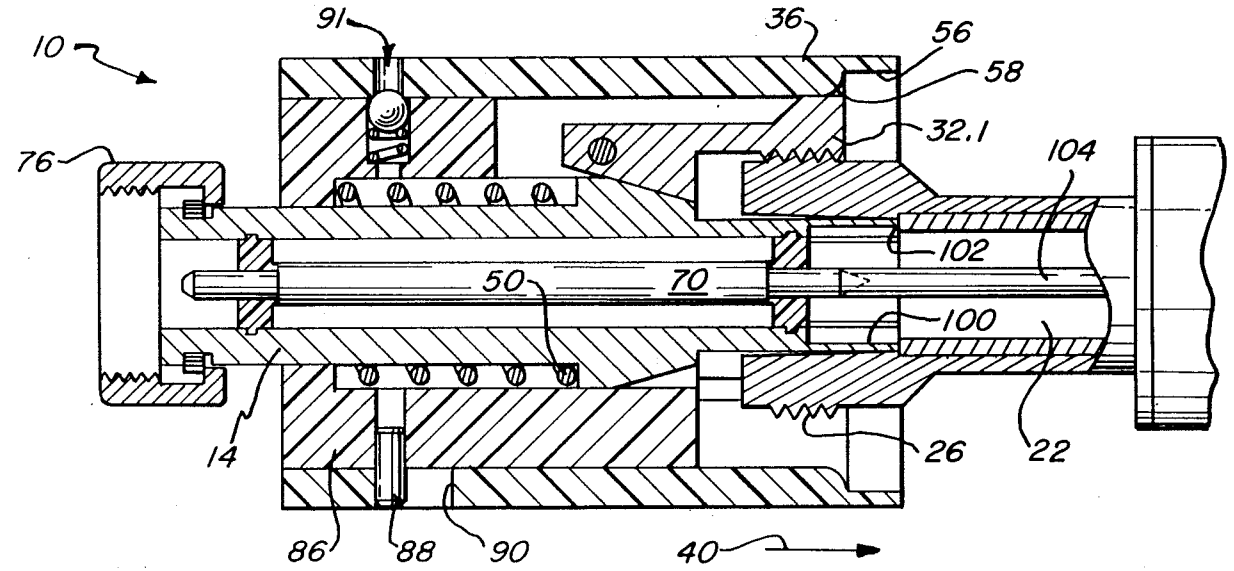
FIG. 4 is a side cross-section view of the connector of FIG. 1 as in FIG. 3 but in a mating connection with the coupling.

As shown in FIG. 4 when connector 10 is pushed onto a coupling 12, the forward end 20 of coaxial line segment 14 initially is properly seated with the mating coaxial line portion of coupling 12. In the case of a type N connection 20, its outer conductor part 100 is seated against edge 102 of the outer conductor in coupling 12 while the central conductors 70, 104 engage as shown.

Further push-on after seating of connector 10 in the direction of arrow 40 by sleeve 36 forces the moveable line segment 14 backward against the bias of spring 50. This enables inwardly-facing cam surface 58 on sleeve 36 to push the fingers into interlock with screw thread 26 until pin 88 engages the end of slot 90. At this position, the flat part of cam surface 58 is opposite generally parallel surfaces on the back of fingers 30 and the latter's ridge portions 32 are meshed with screw thread 26.

The interlock of fingers 30 with screw thread 26 provides a strong stable coaxial connection that is tolerant of handling and maintains a high quality coaxial connection. Disconnection is easily and quickly obtained by pulling sleeve 36 backward. This releases the fingers from their interlock position and facilitates disengagement.

In one embodiment for a connector 10 as shown in the drawings, the sleeve's axial motion was as small as about one-eighth of an inch. Larger motions can be accommodated.

Having thus explained one embodiment of the invention, variations thereof can be implemented without altering the spirit and scope of the invention as set forth in the following claims.

What is claimed is:

1. A microwave connector for quick connection to and disconnection from a microwave coupling having externally facing ridges, comprising:

a housing body;

a microwave line segment having a conductor that terminates at a forward end, said microwave line segment being mounted to the housing body and being movable relative thereto between forward and rearward positions;

the forward end of the microwave line segment being shaped so as to be able to be pushed onto the microwave coupling to establish a microwave connection between the microwave line segment and the microwave coupling;

said housing body having a plurality of fingers with inwardly-facing ridge portions that interlock with the externally-facing ridges on the microwave coupling, said fingers being moveable from an open position to an interlock position that is towards the microwave line segment, with the space between the fingers being sufficient to receive the microwave coupling to enable it to establish a microwave connection with the microwave line segment while bringing the externally-facing ridges in juxtaposed relationship with the ridges on the fingers;

an outer sleeve mounted over the housing body and its fingers and being moveable relative thereto in forward and rearward directions, said sleeve having an inwardly-facing cam surface that in one rearward position of the sleeve enables the fingers to move to their open positions and in another forward position forces the fingers to move inwardly so that their inwardly-facing ridge portion interlock with the externally-facing ridges of a microwave coupling that is in microwave connection with the microwave line segment;

means for biasing the microwave line segment towards its forward position with respect to the outer sleeve and said fingers towards their open position;

the forward end of the microwave line segment being located so as to form an abutting microwave connection when forward motion of the sleeve causes the fingers to become interlocked with the ridges on a microwave coupling;

whereby said microwave connector can be quickly-connected to and quickly disconnected from the microwave coupling by respectively pushing and pulling on the outer sleeve.

2. The microwave connector as claimed in claim 1 and further including means for limiting relative motion between the sleeve and the housing body between a rearward release position and a forward lock position.

3. The microwave connector as claimed in claim 1 wherein said biasing means comprises:

a spring operatively-mounted between the housing body and the microwave line segment so as to spring load the latter forwardly; and cam surface on the line segment and the fingers, said cam surfaces being located so that in response to the spring loading of the microwave line segment, the fingers are urged to their open position.

4. The microwave connector as claimed in claim 3 wherein said fingers are pivotally-connected to the housing at pivots and said cam surfaces are located forwardly of the pivots.

5. The microwave connector as claimed in claim 4 wherein the cam surfaces of the fingers and the microwave line segment are sized to interfere with a forward escape of the segment, and wherein the forward spring loading biases the fingers against the inwardly-facing cam surface of the sleeve.

6. The microwave connector as claimed in claim 5 wherein the means for limiting relative motion comprises a slot in the sleeve and a pin in the housing extending into the slot.

7. A coaxial connector for quick connection to and quick disconnection from a conventional coaxial coupling having an external screw thread that normally is engaged by a screw thread inside a sleeve of a conventional mating connector, comprising:

a coaxial line segment having a center-conductor surrounded by an outer conductor, said coaxial line segment having a forward end that can be pushed onto the coaxial coupling for microwave coupling therewith;

a housing having a through bore in which the coaxial line segment is axially-movably mounted, said housing further having a plurality of fingers with inwardly-facing screw thread portions that mesh with the external screw thread of the coaxial coupling; said fingers being moveable from an open position below which the coaxial coupling can be received to a closed portion where the inwardly-facing screw thread portions of the fingers mesh with the external screw thread of the received coaxial coupling;

means for coupling the coaxial line segment to the fingers so that in a forward axial position of the coaxial line segment, the fingers are biased to their open positions and when the coaxial to operative connection with a conventional coaxial coupling the fingers are enabled to move inwardly; and an outer sleeve mounted over the housing and its fingers and being slidable relative to the housing, said sleeve having an inwardly-facing cam surface that is shaped so that, in a rearward position of the sleeve, the fingers can move to their open position; while, in a forward position of the sleeve, the fingers are forced inwardly to cause their screw thread portions to mesh with the external screw thread of the coaxial coupling and lock it to the housing.

8. The coaxial connector as claimed in claim 7, wherein the forward end of the coaxial line segment is shaped to make an abutting microwave coupling engagement with the coaxial coupling when the coaxial line segment is pushed thereon.

9. The coaxial connector as claimed in claim 8, means for biasing the coaxial line segment towards a forward position, and wherein said coaxial line segment is provided with a cam surface that engages the fingers to move them to their open position in response to the bias on the coaxial line segment.

10. The coaxial connector as claimed in claim 9 and including:

a spring operatively seated between the housing and the coaxial line segment so as to spring load it forwardly.

11. The coaxial connector as claimed in claim 10 wherein said fingers are pivotally-mounted to the housing and have cam surfaces oriented to operatively contact the cam surface on the coaxial line segment, said spring load on the line segment being effective to pivot the fingers toward the outer sleeve.

12. The coaxial connector as claimed in claim 11 wherein the cam surfaces extend into the forward path of the coaxial line segment to retain it within the housing bore while the fingers are urged against the sleeve's cam surface.

13. The coaxial connector as claimed in claim 12 and further comprising:

detent means operative between the housing and the sleeve to provide a detent position of the sleeve in a forward position thereof where the fingers are locked onto the coaxial coupling.

14. The coaxial connector as claimed in claim 13 and further comprising:

means for capturing the sleeve to the housing and limit forward and rearward motion of the sleeve.

* * * * *